US010004962B2

(12) United States Patent
Codd et al.

(10) Patent No.: US 10,004,962 B2
(45) Date of Patent: Jun. 26, 2018

(54) SPORT STICK TRAINING WEIGHT

(71) Applicant: BK BROWN ENTERPRISES, INC., San Diego, CA (US)

(72) Inventors: Daniel Shawn Codd, San Diego, CA (US); Timothy Edward Brown, San Diego, CA (US)

(73) Assignee: BK BROWN ENTERPRISES, INC., San Diego, CA (US)

( * ) Notice: Subject to any disclaimer, the term of this patent is extended or adjusted under 35 U.S.C. 154(b) by 0 days. days.

(21) Appl. No.: 15/650,947

(22) Filed: Jul. 16, 2017

(65) Prior Publication Data

US 2018/0015340 A1 Jan. 18, 2018

Related U.S. Application Data

(60) Provisional application No. 62/363,616, filed on Jul. 18, 2016.

(51) Int. Cl.

| | |
|---|---|
| ***A63B 69/00*** | (2006.01) |
| ***A63B 60/24*** | (2015.01) |
| ***A63B 69/36*** | (2006.01) |
| ***A63B 69/38*** | (2006.01) |
| *A63B 102/18* | (2015.01) |

(52) U.S. Cl.

CPC ..... *A63B 60/24* (2015.10); *A63B 69/00* (2013.01); *A63B 69/0002* (2013.01); *A63B 69/0024* (2013.01); *A63B 69/3632* (2013.01); *A63B 69/38* (2013.01); *A63B 2102/18* (2015.10); *A63B 2102/182* (2015.10)

(58) Field of Classification Search

CPC ..... A63B 60/24; A63B 69/00; A63B 69/0002; A63B 69/0024; A63B 69/3632; A63B 69/38; A63B 2102/18; A63B 2102/182

USPC ..... 473/437, 422, 457, 564, 568, 519, 521, 473/538, 231, 297, 44; D21/753, 725, D21/727

See application file for complete search history.

(56) References Cited

U.S. PATENT DOCUMENTS

| | | | | |
|---|---|---|---|---|
| 3,469,839 | A * | 9/1969 | Pietronuto | A63B 60/00 473/564 |
| 3,521,883 | A | 7/1970 | Hamilton | |
| 4,260,150 | A * | 4/1981 | Tabet | A63B 69/0002 473/437 |
| 5,094,453 | A * | 3/1992 | Douglas | A63B 60/02 473/566 |
| 5,501,450 | A | 3/1996 | Nolan | |
| 5,624,114 | A * | 4/1997 | Kelsey | A63B 60/10 473/457 |
| 5,653,440 | A | 8/1997 | Nolan | |
| 5,674,138 | A | 10/1997 | Nolan | |
| 5,741,193 | A | 4/1998 | Nolan | |
| 6,022,281 | A | 2/2000 | Nolan | |

(Continued)

*Primary Examiner* — Mitra Aryanpour

(74) *Attorney, Agent, or Firm* — David Duckworth

(57) ABSTRACT

A training weight for a sport stick is provided. The sport stick includes a housing having a sidewall, a proximal end wall and a distal end wall. The sidewall and proximal end wall include an opening and slot which are sized to accept a sport stick's handle and knob. Preferably, the training weight includes a cup which is biased by a spring to force the sport stick's knob to engage and lock to the training weight's proximal end wall. The training weight may include a cam mechanism to permit the retraction and extension of the spring and cup.

3 Claims, 5 Drawing Sheets

(56) References Cited

U.S. PATENT DOCUMENTS

| | | | | |
|---|---|---|---|---|
| 6,277,040 | B1 * | 8/2001 | Randolph | A63B 15/00 473/457 |
| D523,105 | S * | 6/2006 | Bernacchi | D21/725 |
| 7,169,069 | B1 * | 1/2007 | Dalton | A63B 69/0002 473/568 |
| 8,231,484 | B1 | 7/2012 | Quinn | |
| 8,944,943 | B2 * | 2/2015 | Heiberg | A63B 60/28 473/457 |
| 8,998,754 | B2 * | 4/2015 | Shocklee | A63B 69/0002 473/566 |
| 9,126,082 | B2 * | 9/2015 | Schacht | A63B 69/3638 473/521 |
| 2004/0248676 | A1 * | 12/2004 | Taylor | A63B 49/08 473/457 |
| 2011/0275458 | A1 | 11/2011 | Estrada, Jr. et al. | |
| 2014/0335967 | A1 * | 11/2014 | Schacht | A63B 69/3638 473/437 |

* cited by examiner

SPORT STICK TRAINING WEIGHT

RELATED APPLICATIONS

The present application is a continuation of U.S. Patent Application Ser. No. 62/363,616 filed on Jul. 18, 2016.

BACKGROUND OF THE INVENTION

The present invention relates to training devices for elongated sport sticks, clubs, racquets and bats, particularly the implementation, design and manufacture of a training weight applied to the knob end of such sporting goods. More particularly, the present invention relates to training weights that can be affixed to any elongated sport stick having a proximal end knob feature, such as baseball bats, softball bats, golf clubs, lacrosse sticks, hockey sticks, cricket bats, tennis and other racquets.

Often ballplayers struggle with proper hitting mechanics, such as driving their hands through the proper hitting zone throughout the entire swinging motion, as well as generating maximum bat speed. To improve an athlete's swing, training weights have been affixed to a sport stick. Training weights for sport sticks are typically applied to the elongated region some distance away from the user's hands. For example, U.S. Pat. No. 3,521,883 describes baseball bats which are weighted with an annular ring of a fixed diameter, wedged onto the barrel of the bat. This configuration increases the mass and inertia of the sport stick, and ideal for warm-up practice swing purposes, but fails to allow for active play with the training weight applied. Additionally, the mass distribution of the sport stick is altered, encouraging the user's hands to be pulled away from their body in a less than optimal manner.

Alternative attempts have been made to modify the amount of the weight. For example, U.S. Pat. No. 8,231,484 describes a construction which permits the weight to be increased or decreased, but in the case of baseball bats, one that still obstructs the hitting region. Attempts have been made to keep the hitting region usable. U.S. Patent Application No. 2011/0275458 describes a construction whereby weight is affixed near the barrel of the bat beyond the user's hands. Unfortunately, this construction would encourage improper swing mechanics.

Accordingly, it would be desirable to provide a sport stick training weight that can be affixed to a sport stick adjacent to the user's hands, thereby enabling live hitting, batting, or other practice with proper technique and increased speed with the sport stick weight attached.

Furthermore, it would be desirable to provide a sport stick training weight that can be affixed and removed from a sport stick's handle quickly and easily.

SUMMARY OF THE INVENTION

The present invention is directed to a training weight which can be affixed or easily removed from the knob of any sport sticks. The training weight is believed to have particular application for affixing to baseball and softball bats. However, the training weight can be utilized in connection with any sport stick having a knob including golf clubs, lacrosse sticks, hockey sticks, tennis racquets, etc. Each of these sport sticks include an elongate shaft having first and second ends. The first end of the sport stick is referred to herein as the handle portion which is typically cylindrical and sized for being gripped by a person's hands. In addition, the sport stick includes a knob which projects radially to extend beyond the handle.

The training weight of the present invention is constructed to affix to the sport stick's knob. To this end, the training weight includes a housing having a sidewall, distal end wall and proximal end wall. The sidewall extends circumferentially so as to form a central conduit which is closed by the distal and proximal end walls to form a central cavity. The training weight's housing may be made of any material as can be selected by those skilled in the art. However, since this housing is intended to function as the mass of the training weight and be utilized by athletes in a sporting environment, it is preferred that the housing be made of steel, aluminum or cast iron.

The training weight's housing includes an opening and a slot to allow the sport stick's knob to enter and exit the housing's central cavity. The sidewall opening is formed at the proximal end of the sidewall and extends circumferentially to have a width at least the diameter of the knob that is to be accepted into the housing's central cavity. Meanwhile, the slot is formed in the proximal end wall and extends from the sidewall opening radially inward to beyond the center of the proximal end wall. The slot has a width greater than the handle portion of the sport stick which it is intended to be affixed to, but the slot has a width smaller than the diameter of the sport stick's knob.

The training weight further includes a spring located within the housing's central cavity. The spring has a first end which engages the housing's distal end wall and a second end positioned to be axially movable within the housing's central cavity. The spring can be any type of spring as can be selected by those skilled in the art. However, a preferred spring for use within the training weight is a helical coil compression spring.

Preferably, the training weight includes a cup affixed to the spring's second end. The cup has a depression sized for receipt of the sport stick knob. This cup may be constructed from, or coated with, a resilient elastometeric material having a high coefficient of friction. Once a sport stick knob has been inserted into the training weight's central cavity, the user depresses the sports stick axially within the cavity, which may release a cam mechanism and the cup and spring work in unison to force the sport stick's knob against the proximal end wall so as to lock the training weight in place. Preferably, the training weight includes a cam mechanism allowing the cup to be locked in a retracted distal position to allow the sport stick knob to be inserted through the sidewall's opening without interference. Alternatively, the cam mechanism allows the cup and spring to be extended so as to force the sport stick's knob into the proximal end wall. The cam mechanism can be constructed in innumerable manners as can be selected by those skilled in the art.

Thus, it is an object of the present invention to provide a training weight which can be affixed to a sport stick knob without interfering with the striking surface of the sport stick.

It is still an additional object of the invention to provide a training weight which can be affixed to a sport stick at its location closest to the athlete's body.

Furthermore, it is an object of the invention to provide a training weight which can be easily and securely affixed to a sport stick knob, and easily removed from a sport stick knob.

These and other more specific objects and advantages of the invention will be apparent to those skilled in the art from the following detailed description taken in conjunction with the drawings.

DETAILED DESCRIPTION OF THE INVENTION

Figure 1:
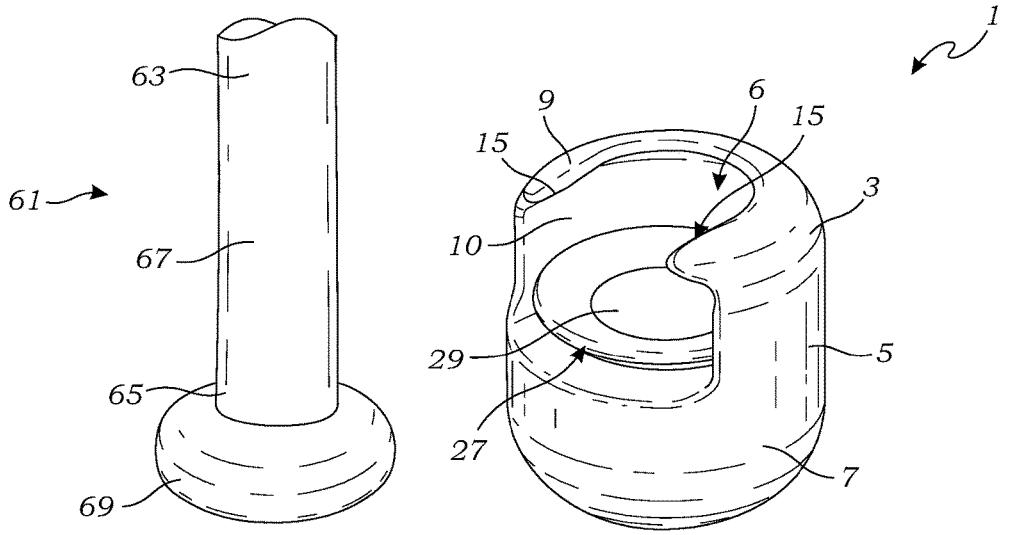
FIG. 1 is a perspective view of a handle portion of a sport stick and the training weight of the present invention.
Figure 2:
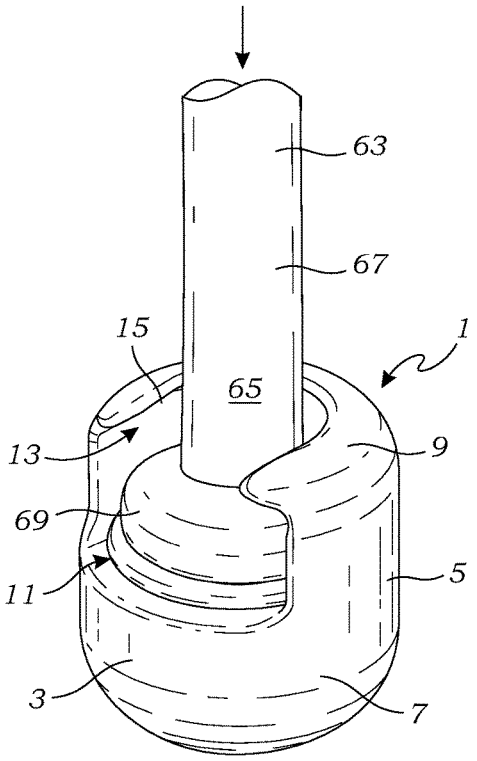
FIG. 2 is a perspective view illustrating a sport stick and training weight after the sport stick's knob has been inserted into the training weight's central cavity.
Figure 3:
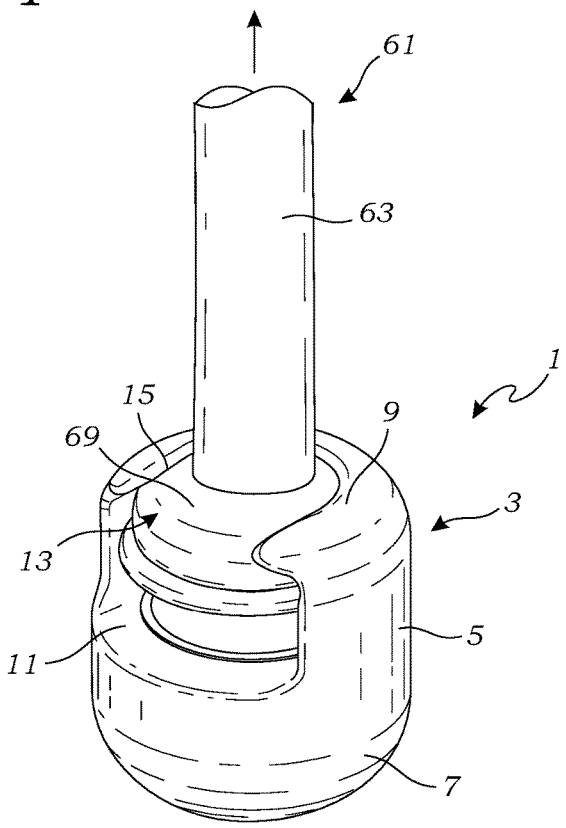
FIG. 3 is a perspective view of the sport stick and training weight combination of FIG. 2 wherein the training weight's cup has been extended.

While the present invention is susceptible of embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated.

With reference to FIGS. 1-10, the present invention is a training weight 1 for use with a sport stick 61. The sport stick may be any type of club having a shaft 63, with first end 65 and a second end. At the shaft's first end 65, the sport stick 61 has a handle portion 67 and a radially projecting knob 69. The sport stick's shaft 63 is preferably substantially cylindrical, at least at the handle portion 67 where the sport stick 61 is gripped by a user. The shaft's handle portion 67 has a diameter sized for being held by a person's hand. Meanwhile, the sport stick's knob 69 has a diameter greater than the diameter of the sport stick's handle portion so that the knob projects radially beyond the handle portion 67. As would be understood by those skilled in the art, this sport stick construction including an elongate substantially cylindrical shaft and a radially projecting knob is employed in a wide variety of sport sticks including baseball bats, softball bats, golf clubs, lacrosse sticks, hockey sticks, cricket bats, and tennis racquets. For purposes herein, the sport stick will be described and illustrated as a baseball bat, but the invention is not intended to be so limited.

With reference to FIGS. 1-10, the training weight 1 is constructed to affix to the sport stick's knob 69. To this end, the training weight 1 includes a housing 3 having a sidewall 5, a distal end wall 7, and a proximal end wall 9. The training weight's sidewall 5 extends circumferentially to form a central conduit 6 which is closed at each of its ends by the distal end wall 7 and proximal end wall 9, respectively, to form a central cavity 10. The sidewall 5 may be constructed in various shapes and sizes including cubic, spheroid or ellipsoid. However, in the preferred embodiments illustrated in the figures, the training weight's sidewall 5 has a substantially cylindrical tubular shape.

To allow the training weight 1 to "grasp" a sport stick's first end 65, the training weight sidewall 5 has an opening 11 which is located adjacent to the training weight's proximal end wall 9. The sidewall's opening 11 is sized to accept the sport stick's knob 69. More specifically, the opening 11 extends circumferentially to have a width which is greater than the sport stick knob's diameter. In addition, the training weight 1 possesses a slot 13 formed in the proximal end wall 9. The slot extends from the sidewall's opening 11, at the proximal end wall's periphery, radially inward to beyond the center of the proximal end wall. Preferably, the slot 13 extends half the diameter of the sport stick's handle beyond the center of the proximal end wall 9 so that when mated together, the sport stick 61 extends axially from approximately the middle of the training weight's proximal end wall 9. As illustrated in FIGS. 1-4, the proximal end wall slot 13 has a width greater than the diameter of the sport stick's handle diameter so as to allow entry of the sport stick's handle 67 into the slot 13, but the slot's width is smaller than the diameter of the sport stick's knob 69 so that once the sport stick's knob 69 is located within the training weight's central cavity 10, the sport stick and its knob 69 cannot be moved axially relative to the training weight 1 because the knob 69 will engage the proximal end wall 9 at the slot's edges 15.

Figures 4, 5, 6:
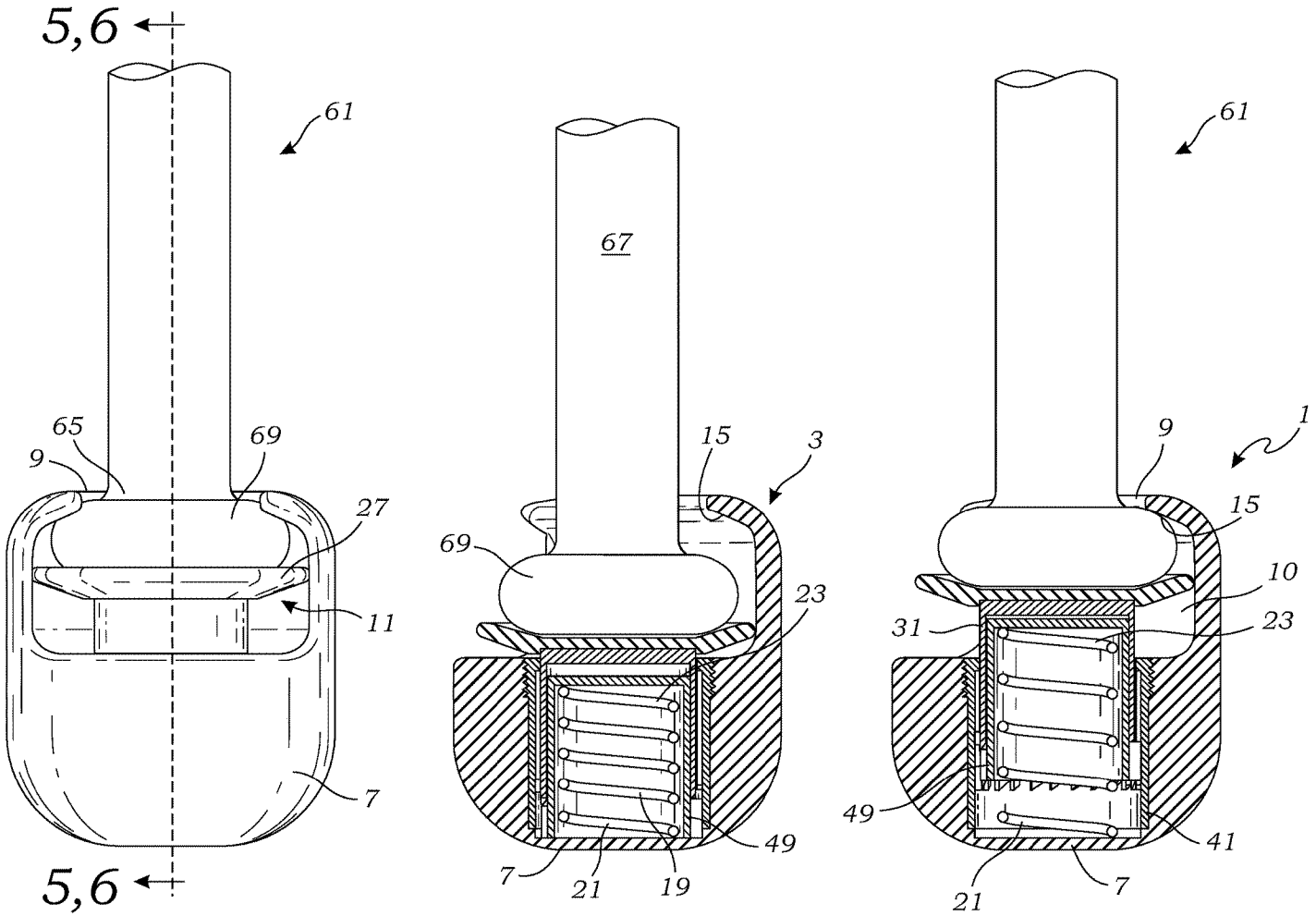
FIG. 4 is a side view of a sport stick and training weight combination illustrated in FIG. 3.
FIG. 5 is a side cutaway view of the sport stick and training weight combination wherein the training weight's cup has been retracted to a retracted condition.
FIG. 6 is a side cutaway view of the sport stick and training weight combination wherein the training weight's cup has been extended to an extended condition.
Figure 7:
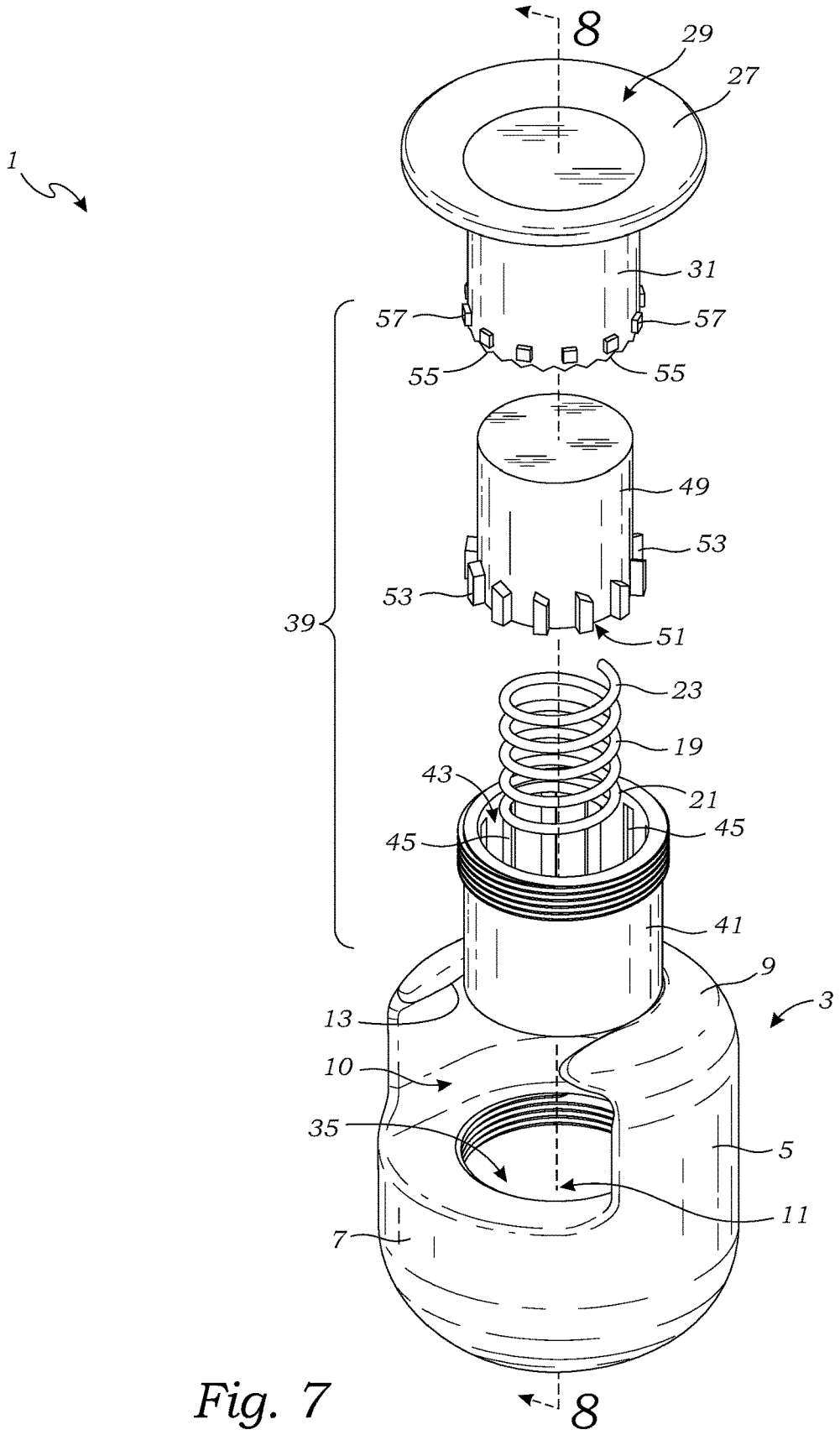
FIG. 7 is a perspective exploded view illustrating the various components of the training weight of the present invention.
Figure 8:
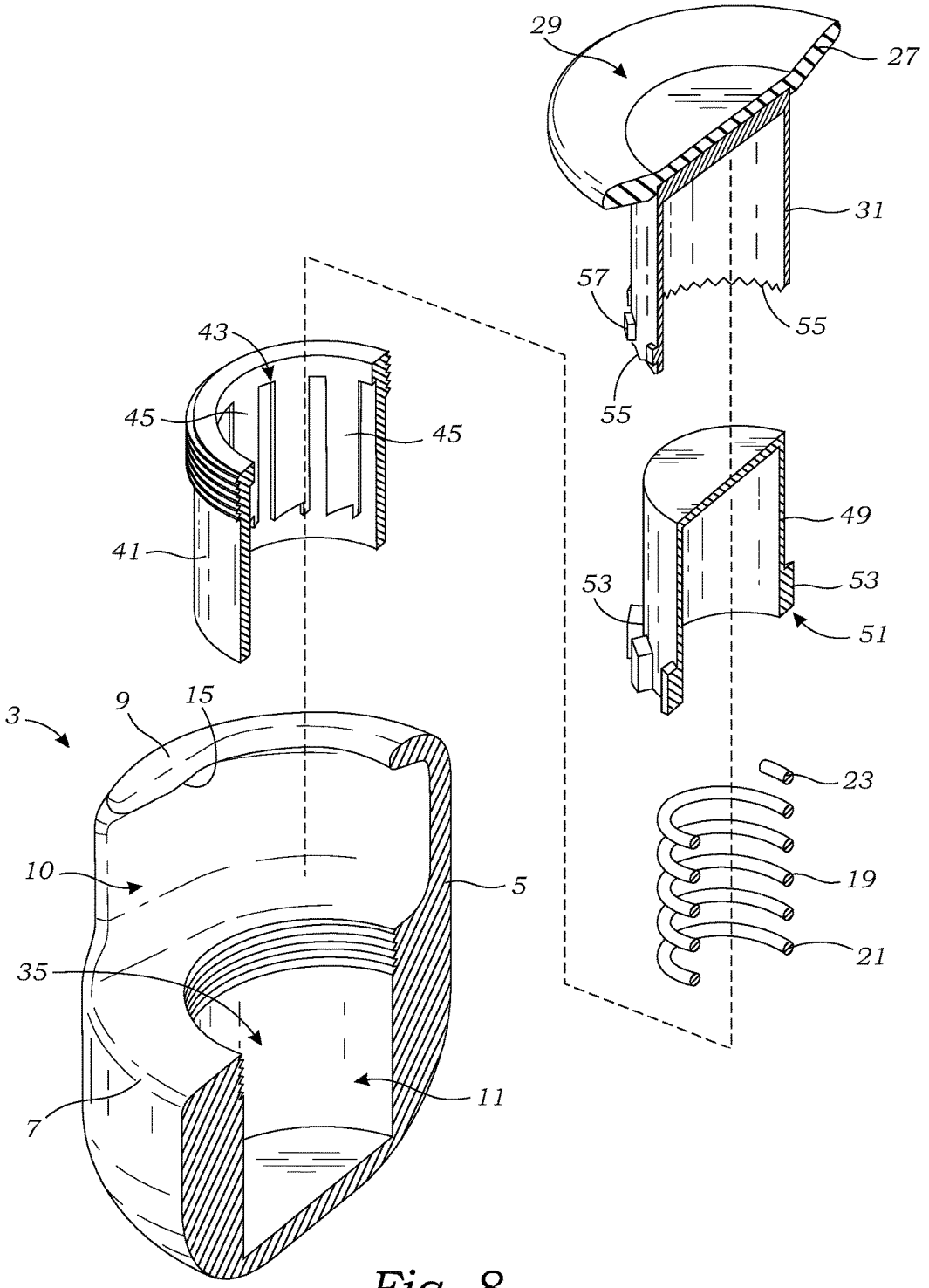
FIG. 8 is a perspective cutaway exploded view of the training weight illustrated in FIG. 7.
Figure 9:
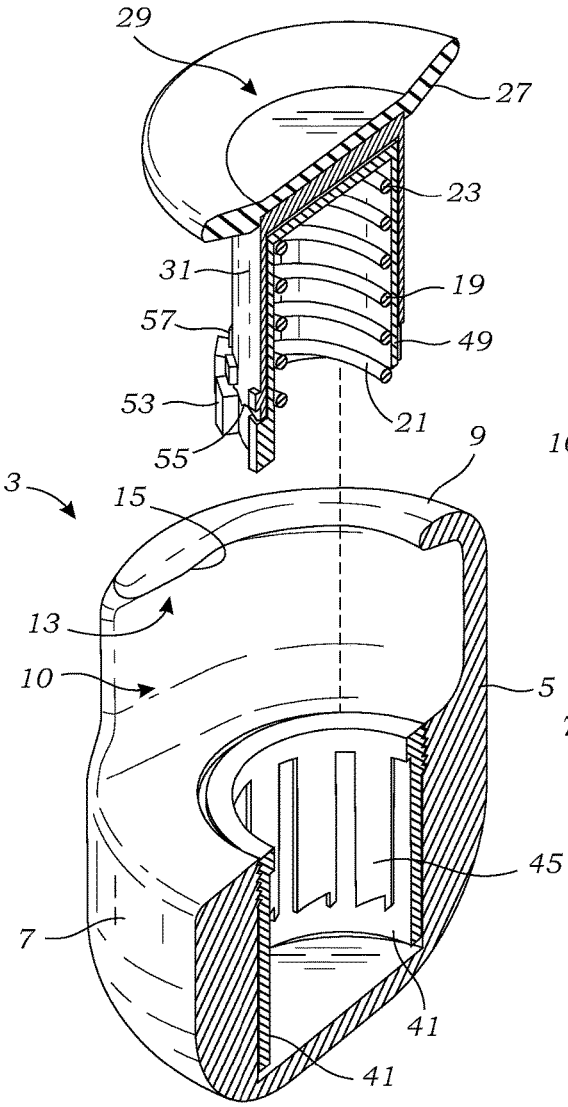
FIG. 9 is a perspective cutaway partially exploded view of the training weight.
Figure 10:
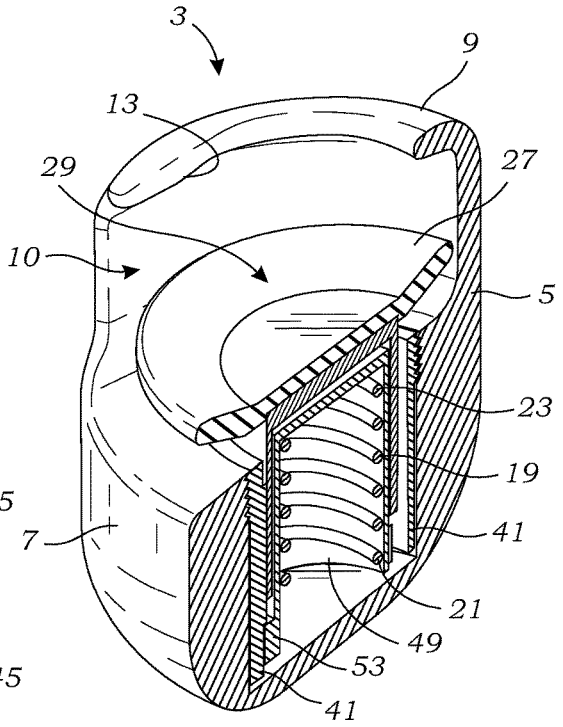
FIG. 10 is a perspective cutaway view of the training weight.

As illustrated in FIGS. 5-7, the training weight 1 includes a spring 19. The spring 19 may be any resilient or elastomeric construction that can be pressed or pulled, but returns to its former shape when released. Acceptable springs include helical springs, leaf springs, or even simple elastic materials such as rubber. However, the preferred spring for use with the training weight 1 is a traditional helical compression spring 19. As illustrated in the figures, the spring 19 includes a first end 21 which engages the housing's distal end wall 7. The spring's second end 23 is positioned within the training weight's central cavity 10 so as to be axially movable so as to force a sport stick's knob 69 axially in the proximal direction. In a preferred embodiment, the training weight 1 further includes a conical cup 27. The conical cup 27 is affixed to the spring's second end 23 and includes a depression 29 sized and positioned so as to receive a sport stick's knob 69.

To affix the training weight 1 to a sport stick's knob 69, the conical cup 27 and spring's second end 23 are depressed axially so as to allow a sport stick's knob 69 to slide through the sidewall's opening 11 with the sport stick's shaft sliding through the proximal end wall's slot 13. The compression of the spring 19 is released thereby forcing the bat's knob 69 against the proximal end wall 9 so as to lock to the training weight 1 to the sport stick's first end 65.

In preferred embodiments illustrated in FIGS. 5-10, the training weight 1 includes a cam mechanism 39 which allows the conical cup 27 to be locked in a retracted condition to permit the knob to be inserted into the training weight's cavity 10. Alternatively, the cam mechanism 39 allows the cup 27 to be released to an extended condition wherein the conical cup 27 is extended proximally so as to force a bat's knob 69 against the proximal end wall 9. The cam mechanism may be constructed in any manner as can be determined by those skilled in the art and may take any of innumerable forms and structures that would allow the cup 27 and spring's second end 23 to be locked in a retracted condition, but selectively released to an extended condition.

In an embodiment illustrated in FIGS. 7-10, the cam mechanism includes a cylindrical tube 31, a tubular outer sleeve 41 and an inner cap 49. The cylindrical tube 31 extends axially and distally from the cup's bottom surface, and includes a cylindrical chamber. In addition, the cylindrical tube 31 has a serrated distal edge 55 forming a plurality of cam surfaces as well as a plurality of teeth 57 which project radially outward from the cylindrical tube's sidewall.

Meanwhile, the cam mechanism's tubular outer sleeve 41 has a central chamber 43 and longitudinally extending guide channels 45 formed into the interior sidewall of the tubular outer sleeve 41. The tubular outer sleeve 41 may be affixed to the training weight's distal end wall 7 by numerous fasteners known to those skilled in the art. However, in a preferred embodiment illustrated in FIG. 7, the training weight's distal end wall 7 includes a recess 35 sized to concentrically receive the tubular outer sleeve 41, and the distal end wall 7 and tubular outer sleeve 41 are affixed together utilizing a male and female threaded fastener engagement. The cam mechanism's inner cap 49 is also cylindrical and includes angular cam surfaces 53 which extend radially outward from the inner cap's sidewall.

The cam mechanism's tubular outer sleeve 41, inner cap 49 and cylindrical tube 31 are arranged telescopically with the tubular outer sleeve 41 forming the outermost member, the cup's cylindrical tube 31 forming the telescopic structure's intermediate member, and the inner cap 49 forming the telescopic structure's interior member. The cup's cylindrical tube 31 is positioned within the tubular outer sleeve 41 with the cup's teeth 57 slidably positioned within the outer sleeve's guide channels 55. The cup's teeth 57 are positioned within the guide channels 55 so as to permit the cup 27 to move longitudinally relative to the tubular outer sleeve 41, but not move rotationally relative to each other. Meanwhile, the cam mechanism's inner cap 49 is positioned within the cylindrical tube 31 in a manner whereby the inner cap's angular cam surfaces 53 engage, and are axially and rotationally slideable upon the cylindrical tube's serrated edge-cam surface 55.

In operation, the spring's second end 23 engages the inner cap 49 so as to force the cylindrical tube 31 and cup 27 axially in the proximal direction. However, the various teeth 57, cam surface 55 and angular cam surfaces 53 allow the cup 27 to be depressed in the distal direction and locked in a retracted condition. This retracted condition can then be released by further depression of the cup 27.

Various modifications of the training weight can be made to affix to various sport sticks. In addition, the various components of the training weight 1 may be made from various materials as can be determined by those skilled in the art. For example, preferably the training weight's housing 3 is made of a heavy material such as steel, cast iron, or aluminum. In addition, the housing may be coated with a softer more compliant material such as rubber or plastic since it is anticipated that the training weight will be utilized by athletes in an aggressive manner. Meanwhile, it is preferred that the training weight's cup 27 and cam mechanism components be made of durable plastics, and that the spring 19 be made of a traditional spring steel. Of course, those skilled in the art may select other materials without departing from the spirit and scope of the present invention.

The training weight 1 may be constructed to weigh anything as can be selected to improve an athlete's swing. However, a preferred training weight 1 for use with a baseball or softball bat has a weight of 5-40 oz. Additionally, the training weight 1 may be constructed so as to allow persons to selectively add or subtract weight such as by introducing additional components to the training weight's interior, or affixing additional weights to the training weight's exterior. Accordingly, it is not intended that the invention be limited except by the following claims.

The invention claimed is:

1. A sport stick and training weight combination comprising:

a sport stick having an elongate substantially cylindrical shaft having first and second ends, said sport stick having a circular knob affixed to said shaft's first end and said shaft having a handle portion adjacent to said knob, said knob's diameter being greater than said handle portion's diameter;

a training weight having, a circumferential sidewall forming a central conduit and having a proximal end and a distal end;

a distal end wall engaging and closing said sidewall's distal end;

a proximal end wall engaging said sidewall's proximal end, said sidewall, distal end wall, and proximal end wall forming a central cavity;

said sidewall having an opening adjacent said proximal end wall, said opening extending circumferentially to define said opening's width; and a slot formed in said proximal end wall, said slot extending from said sidewall's opening radially inward to beyond the center of said proximal end wall, said proximal end's slot having a width greater than said sport stick's handle's diameter but said slot's width smaller than said sport stick's knob's diameter, and said sidewall's opening's width being greater than said proximal end's slot's width and greater than said sport stick's knob's diameter; and a spring located within said central cavity, said spring having a first end positioned at said distal end and a second end positioned to be axially movable within said cavity, and said sport stick's knob positioned within said cavity with said spring's second end biasing said sport stick's knob in the proximal direction.

2. The sport stick and training weight combination of claim 1 further comprising a cup engaging said spring's second end, said cup having a depression sized for receipt of a sport stick knob.

3. The sport stick training weight of claim 1 further comprising a cam mechanism that will lock the cup in a retracted condition or permit the cup to extend to an extended condition.

* * * * *